US006384310B2

(12) United States Patent
Aoki et al.

(10) Patent No.: US 6,384,310 B2
(45) Date of Patent: May 7, 2002

(54) AUTOMATIC MUSICAL COMPOSITION APPARATUS AND METHOD

(75) Inventors: Eiichiro Aoki; Yoshiko Fukushima, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/907,802

(22) Filed: Jul. 18, 2001

(30) Foreign Application Priority Data

Jul. 18, 2000 (JP) ..... 12-217644

(51) Int. Cl.[7] ..... A63H 5/00; G04B 13/00; G10H 7/00

(52) U.S. Cl. ..... 84/609; 84/649

(58) Field of Search ..... 84/609–612, 634–636, 84/649–652

(56) References Cited

U.S. PATENT DOCUMENTS 4,926,737 A 5/1990 Minamitaka ..... 84/611
5,736,663 A * 4/1998 Aoki et al. ..... 84/609
6,124,543 A * 9/2000 Aoki ..... 84/609
6,143,971 A 11/2000 Aoki et al. ..... 84/609
6,162,982 A * 12/2000 Aoki ..... 84/609 X
6,245,984 B1 * 6/2001 Aoki et al.
6,252,152 B1 * 6/2001 Aoki et al. ..... 84/609

* cited by examiner

*Primary Examiner*—Jeffrey Donels
(74) *Attorney, Agent, or Firm*—Rossi & Associates

(57) ABSTRACT

Through an operation by a user, a setting is made, for each partial musical section in a music piece, as to whether or not music piece data should be generated. In accordance with the setting, a discrimination is made between a data-generating musical section where music piece data should be generated and a non-data-generating musical section where music piece data should not be generated. In automatically composing a music piece on the basis of given musical conditions, music piece data based on the given musical conditions is generated only for the data-generating musical section, and generation of music piece data based on the given musical conditions is inhibited for the non-data-generating musical section. With this arrangement, music piece data for each partial musical section in an already-composed or existing music piece can be re-created with greatly increased ease.

33 Claims, 3 Drawing Sheets

AUTOMATIC MUSICAL COMPOSITION APPARATUS AND METHOD

BACKGROUND OF THE INVENTION

The present invention relates generally to automatic musical composition apparatus and methods for automatically composing a melody in accordance with various musical conditions, and more particularly to an improved automatic musical composition apparatus and method which permit creation of a melody only for a selected musical section in a music piece.

The recent proliferation or widespread use of personal computers has allowed every interested person to freely enjoy music by using computer music techniques, for example, to play a musical instrument, compose and arrange a music piece and synthesize a tone color. Particularly, in the field of musical composition using a computer, there have emerged automatic musical composition apparatus which allow even a beginner with poor musical expertise to enjoy composing a music piece in a simple manner. Known examples of the automatic musical composition apparatus include one which is designed to automatically create a melody on the basis of various input musical parameters characterizing a melody (hereinafter referred as "melody creating parameters"), such as those pertaining to a musical key, musical time, pitch leap dynamics, presence/absence of syncopation and chord progression. In cases where such an automatic musical composition apparatus is employed, a user can compose various melodies freely and simply by selectively inputting melody creating parameters to the computer-based musical composition apparatus.

The conventional automatic musical composition apparatus are generally designed to automatically create a melody for an entire music piece on the basis of the input melody creating parameters. Thus, when the user does not like (or is not satisfied with) only a particular portion of the automatically-created melody and if the user again causes the automatic composing processing to be executed with a view to modifying that particular portion, the automatic musical composition apparatus would automatically re-create the melody for the entire music piece including portions of the melody that need not be changed at all. Namely, heretofore, the user was not allowed to selectively re-create or modify only a particular portion of the automatically-created melody while leaving the remaining portions of the melody unchanged to be used as they are. Therefore, the conventional automatic musical composition apparatus would provide a very poor usability to users.

SUMMARY OF THE INVENTION

In view of the foregoing prior art problems, the present invention provides an improved automatic musical composition apparatus which comprises: a processing section that automatically composes a music piece on the basis of a given musical condition; and a setting section that, for each partial musical section in a music piece, makes a setting as to whether or not music piece data should be generated for the partial musical section. Here, the processing section discriminates, in accordance with the setting made by the setting section, between a data-generating musical section where music piece data should be generated and a non-data-generating musical section where no music piece data should be generated, and generates music piece data based on the given musical condition for the data-generating musical section without generating music piece data based on the given musical condition for the non-data-generating musical section.

The setting section may make a setting, for each partial musical section in an already-composed music piece, as to whether or not music piece data should be generated for that partial musical section. Thus, music piece data for the data-generating musical section in the already-composed music piece is re-generated by the processing section, while music piece data for the non-data-generating musical section in the already-composed music piece is left unchanged. In this way, the already-composed music piece can be modified as desired. With the inventive arrangement that music piece data, such as melody data, is generated only for any designated musical section, the user can re-create only a selected partial musical section in the already-composed music piece. Namely, only a partial musical section having a melody the user does not like (or is not satisfied with) can be re-created any number of times. With this arrangement, the present invention can readily compose melodies which have a very high degree of musical completeness or perfection. Further, because the music piece data generation is inhibited for the non-data-generating section, it is possible to simultaneously generate or re-generate music piece data for two or more data-generating sections apart from each other with a particular non-data-generating section interposed therebetween, which can also contribute to an enhanced efficiency of automatic musical composition.

In one embodiment, the inventive automatic musical composition apparatus may further comprise an instruction section that instructs whether or not the setting made by the setting section should have priority over a musical composition process based on period marks. In this case, when the instruction section has instructed that the setting made by the setting section should not have the priority over the musical composition process based on the period marks, the processing section ignores the setting made by the setting section for the partial musical section within at least one of at least two periods that are indicated by the period marks as identical or similar to each other.

According to another aspect of the present invention, there is provided an automatic musical composition apparatus which comprises: a processing section that automatically composes a music piece on the basis of a given musical condition; and a setting section that, for each partial musical section in a music piece, makes a setting as to whether or not music piece data should be generated for the partial musical section. Here, the processing section is cable of performing: a first process for discriminating, in accordance with the setting made by the setting section, between a data-generating musical section where music piece data should be generated and a non-data-generating musical section where no music piece data should be generated, and generating music piece data based on the given musical condition for the data-generating musical section without generating music piece data based on the given musical condition for the non-data-generating musical section; and a second process for generating music piece data in accordance with a period mark imparted to each period constituting the music piece. The composition apparatus further comprises an instruction section that instructs the processing section to perform either one of the first and second processes with priority over other of the first and second processes. With the inventive arrangement allowing a desired one of the first and second processes to be performed with priority over the other of the first and second processes, the degree of flexibility or freedom in musical composition by the user can be greatly enhanced, with the result that the user can compose melodies having an even higher degree of musical perfection.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF EMBODIMENTS

Figure 1:
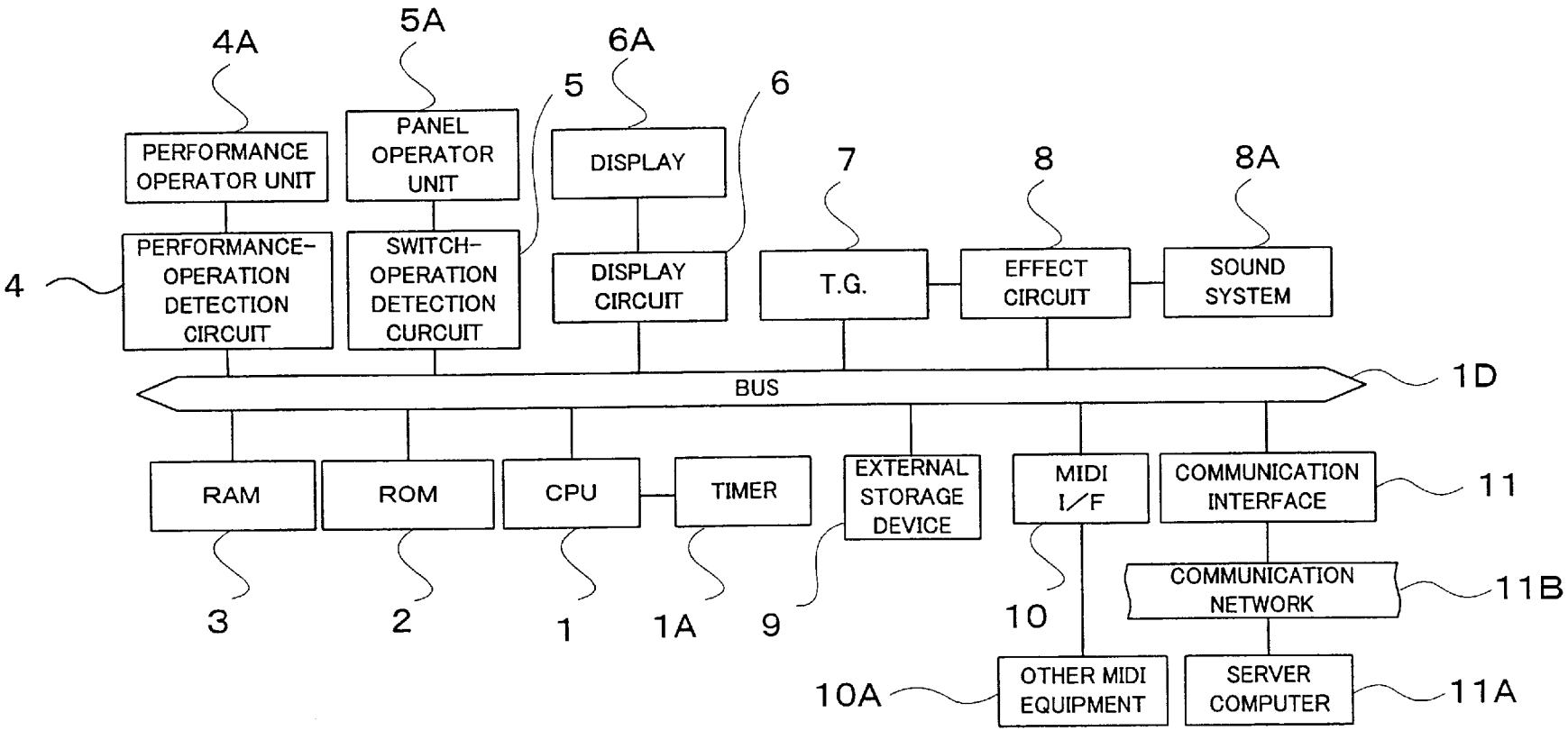
FIG. 1 is a block diagram showing an exemplary general hardware setup of an automatic musical composition apparatus according to an embodiment of the present invention.

FIG. 1 is a block diagram illustrating a general hardware setup of an automatic musical composition apparatus according to an embodiment of the present invention.

This automatic musical composition generation apparatus is controlled by a microcomputer comprising a microprocessor unit (CPU) 1, a read-only memory (ROM) 2 and a random-access memory (RAM) 3. The CPU 1 controls general operation of the automatic musical composition apparatus. To the CPU 1 are connected, via a data and address bus 1D, the read-only memory (ROM) 2, random-access memory (RAM) 3, performance-operation detection circuit 4, switch-operation detection circuit 5, display circuit 16, tone generator (T.G.) circuit 7, effect circuit 8, external storage device 9, MIDI interface (I/F) 10 and communication interface 11. Also connected to the CPU 1 is a timer 1A for counting various time periods, for example, to signal interrupt timing for timer interrupt processes. Namely, the timer 1A generates tempo clock pulses for counting a time interval or setting a performance tempo with which to automatically perform a music piece having been composed by the automatic musical composition apparatus. The frequency of the tempo clock pulses is adjustable via a tempo setting switch or the like included in an operator unit 5A. Such tempo clock pulses generated by the timer 1A are given to the CPU 1 as processing timing instructions or as interrupt instructions. The CPU 1 carries out various processes in accordance with such instructions. The various processes carried out by the CPU 1 in the instant embodiment include processes relating to screen displays during automatic composition, automatic performance of an automatically-composed music piece, etc.

It should be appreciated that the automatic musical composition apparatus of the invention may be other than a dedicated apparatus, such as a general-purpose apparatus like a personal computer or multimedia equipment, as long as the composition apparatus is constructed to execute automatic musical composition using predetermined software or hardware based on the principles of the present invention.

The ROM 2 has prestored therein various programs to be executed by the CPU 1 and various data to be referred to by the CPU 1. The RAM 3 is used as a working memory for temporarily storing various tone information to be used for automatic melody creation (such as information about a hierarchical structure of a melody to be created and melody creating parameters), automatic performance information to be used for automatically performing a music piece having been composed by the composition apparatus, various data generated as the CPU 1 executes the programs. Also, the RAM 3 is used as a memory for storing the currently-executed program and data related thereto. Predetermined address regions of the RAM 3 are allocated and used as registers, flags, tables, etc.

Performance operator unit 4A is in the form of, for example, a keyboard including a plurality of keys for selecting a pitch of each tone to be generated, and a plurality of key switches corresponding to the keys. The performance operator unit 4A can be used not only for a tone performance but also as an input means for entering pitches, rhythm, etc. for musical composition. The performance-operation detection circuit 4 detects every key depression and every key release on the performance operator unit 4A to provide corresponding detection outputs. Panel operator unit 5A includes various switches and operators for designating various parameters and inputting music performance conditions to be used for automatically performing a music piece. For example, the panel operator unit 5A includes melody creating switches for making a selection or setting as to whether or not a melody is to be created for a predetermined partial musical section of a music piece, and a priority designating switch for instructing whether priority should be given to period marks or to the melody creating switches, as will be later described in detail. Of course, the panel operator unit 5A may also include a ten-button keypad for entry of numeric value data to be used for selecting, setting and controlling a tone pitch, color, effect, etc. The switch-operation detection circuit 5 constantly detects respective operational states of the individual operators on the panel operator unit 5A and outputs switch information and data, corresponding to the detected operational states of the operators, to the CPU 1 via the data and address bus 1D. The display circuit 6 visually displays various information on a display device 6A that may comprise an LCD (Liquid Crystal Display) or CRT (Cathode Ray Tube). Examples of the various information include settings, made on the basis of the melody creating parameters and operational states of the melody creating switches, as to whether or not a melody is to be created. In addition, the display circuit 6 displays on the display device 6A various other information pertaining to an automatic performance, controlling state of the CPU 1, etc.

Figure 2:
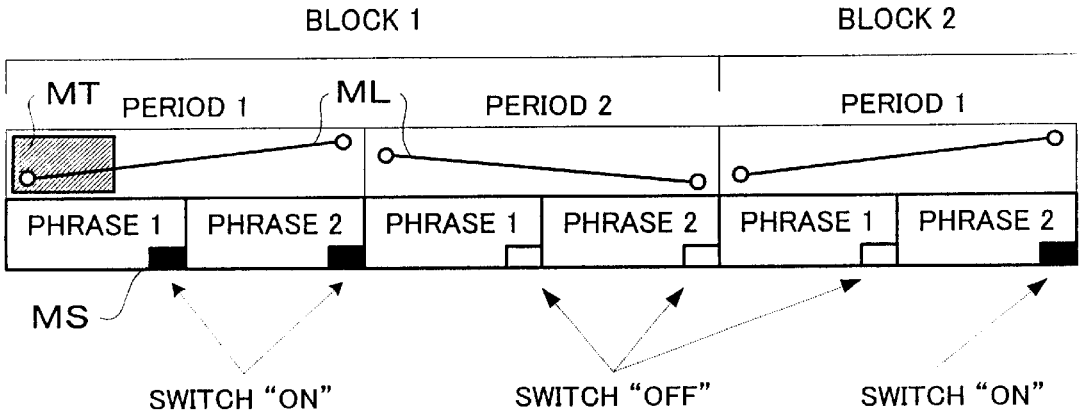
FIG. 2 is a diagram conceptually showing exemplary arrangement and operation of melody creating switches employed in the embodiment of FIG. 1.

The following paragraphs briefly describe the melody creating switches, with reference to FIG. 2 showing exemplary arrangement and operation of the melody creating switches MS. In the illustrated example of FIG. 2, the melody creating switches MS are each implemented as a software switch displayed on the display device 6A so that it can be turned on and off by the user using a mouse or the like to click the picture of the switch.

As seen from FIG. 2, one of the melody creating switches MS is visually displayed on the display device 6A for each of a plurality of partial (or unit) musical sections of a melody to be created. In FIG. 2, the melody creating switch MS is provided for each "phrase" (i.e., a musical statement made up of two or more phrases and a cadence) level partial musical section which is a smallest unit of the melody creation. Each melody to be created can be divided into a plurality of partial musical sections, and a melody is created for each of the divided partial musical sections. For example, in the case of a melody comprising two "block-level" partial musical sections (block 1 and block 2), the melody creation can be carried out for each of the blocks, i.e. on a block-by-block basis. Further, because each larger partial musical section of the melody, such as the block-level partial musical section, can be composed of smaller partial musical sectional sections, namely, because the melody is constructed of hierarchical brackets or levels divided in different manners of dividing, the melody creation can be carried out for each of the smaller blocks. For example, in the case of a melody comprising two block-level partial musical sections (block 1 and block 2) where each of the block-level partial musical sections comprises two period-level partial musical sections (period 1 and period 2) and each of the period-level partial musical sections comprises two phrases (phrase 1 and phrase 2), namely, in the case of a melody of a music piece comprising four periods and eight phrases, the melody creation can be carried out for each of the periods or phrases rather than for each of the blocks. Namely, in the instant embodiment, the melody creating switch MS is provided for each of the partial musical sections for which the melody creation is to be carried out. Of course, in stead of the melody creating switch MS being provided for each of the phrases as in the illustrated example, the creating switch MS may be provided for each of the periods or blocks greater (higher in hierarchical level) than the phrase or for each measure smaller (lower in hierarchical level) than the phrase. In other words, the melody creating switch MS may be provided for each partial musical section in any one desired hierarchical bracket or level, for example, as a period switch, phrase switch or the like; alternatively, the melody creating switch MS may be provided for each partial musical section in any two or more desired hierarchical brackets or levels.

In such a case, either the settings of the melody creating switches MS in higher-level partial musical sections (i.e., longer partial musical sections) or the settings of the melody creating switches MS in lower-level partial musical sections (i.e., shorter partial musical sections) may be given a higher priority. Which of the settings of the melody creating switches MS in the higher-level partial musical sections and the settings of the melody creating switches MS in the lower-level partial musical sections should be given the priority is designated or instructed by the user via the priority designating switch (not shown). In the case where the settings of the melody creating switches MS in the higher-level partial musical sections are given the priority, the melody is created in accordance with the settings of the melody creating switches MS in the higher-level partial musical sections irrespective of the settings of the melody creating switches MS in the lower-level partial musical sections. For example, as long as the melody creating switches MS in the period-level partial musical sections are set in the ON (or OFF) state, the melody is re-created in accordance with the ON (or OFF) settings in the period-level partial musical sections, even when the melody creating switches MS in the phrase-level partial musical sections are set in the OFF (or ON) state. Conversely in the case where the settings of the melody creating switches MS in the lower-level partial musical sections are given the priority, the melody is created in accordance with the settings of the melody creating switches MS in the lower-level partial musical sections irrespective of how the melody creating switches MS are set in the higher-level partial musical sections. For example, as long as the melody creating switches MS in the phrase-level partial musical sections are set in the ON (or OFF) state, the melody is re-created in accordance with the ON (or OFF) settings of the switches MS in the phrase-level partial musical sections, even when the melody creating switches MS in the period-level partial musical sections are set in the OFF (or ON) state.

It should be appreciated that any desired combination of the melody creating switches MS may be used to designate a higher-level partial musical section. For example, there may be higher-level switches to instruct melody creation for a combination of phrase 1 and phrase 2 belonging to period 1 in block 1 and phrase 2 belonging to period 1 in block 2, as illustrated in FIG. 2.

Specifically, a melody is created for each partial musical section where the melody creating switch MS is set in the ON state. In the illustrated example of FIG. 2, phrase 1 and phrase 2 belong to period 1 in block 1 and phrase 2 belonging to period 1 in block 2, where the respective melody creating switches MS are in the ON state, are each designated as a melody-generating musical section where the once-created melody is to be created again or re-created. In case, after the melody for the entire music piece has been created, the user desires to re-create the melody of particular partial musical sections (in the illustrated example of FIG. 2, phrase 1 and phrase 2 belonging to period 1 in block 1 and phrase 2 belonging to period 1 in block 2) while using the melody of the other partial musical sections (in the illustrated example, phrase 1 and phrase 2 belonging to period 2 in block 1 and phrase 1 belonging to period 1 in block 2) as they are (as initially created), or in case a melody is to be newly created only for a given partial musical section, it is just necessary that the melody creating switches MS associated with the particular partial musical sections or the melody creating switch MS associated with the given partial musical section be set to the ON state.

The ON/OFF states of the melody creating switches MS may be set such that the ON state sets the corresponding partial musical section as a "melody-generating musical section" while the OFF state sets the corresponding partial musical section as a "non-melody-generating musical section"; namely, in this case, the melody creating switches MS in the ON state each designate the "melody-generating musical section". Alternatively, the ON/OFF states of the melody creating switches MS may be set such that the ON state sets the corresponding partial musical section as the "non-melody-generating musical section" while the OFF state sets the corresponding partial musical section as the "melody-generating musical section"; namely, in this case, the melody creating switches MS in the ON state each designate the "non-melody-generating musical section". Either one of the above-mentioned two manners of setting the ON/OFF states may be employed in the instant embodiment.

Further, each of the melody creating switches MS set in the ON state may be visually shown on the display device 6A as an illuminated mark (or non-illuminated mark) (in the illustrated example of FIG. 2, shown as a painted-in-black rectangle), and each of the melody creating switches MS set in the OFF state may be visually shown on the display device 6A as a non-illuminated mark (or illuminated mark) (in the illustrated example of FIG. 2, shown as a white-out rectangle). In this way, the user is allowed to readily recognize the settings of the melody creating switches MS at a glance, which achieves a very good usability. Namely, by differentiating the displayed mode of the melody creating switch MS between the melody-generating musical section and the non-melody-generating musical section, the user is allowed readily ascertains, at a first glance, which of the partial musical sections is designated as the melody-generating musical section and which of the partial musical sections is designated as the non-melody-generating musical section, so that each partial musical section where the melody creation or re-creation is to be executed can be set in a simple manner.

The partial musical sections set in the manner of FIG. 2 are those of an existing (already-composed) music piece in some cases, and those of a music piece to be newly composed in other cases.

Referring back to FIG. 1, the tone generator (T.G.) circuit 7, which is capable of simultaneously generating tone signals in a plurality of channels, receives performance information supplied via the data and address bus 1D and generates tone signals based on the received performance information. Each of the tone signals thus generated by the tone generator circuit 7 is audibly reproduced or sounded by a sound system 8A. The effect circuit 8 imparts various effects to the tone signals generated by the tone generator circuit 7. Any desired tone signal generation method may be used in the tone generator circuit 7, such as: the memory readout method where sound waveform sample value data stored in a waveform memory are sequentially read out in accordance with address data that vary in correspondence to the pitch of a tone to be generated; the FM method where sound waveform sample value data are obtained by performing predetermined frequency modulation operations using the above-mentioned address data as phase angle parameter data; or the AM method where sound waveform sample value data are obtained by performing predetermined amplitude modulation operations using the above-mentioned address data as phase angle parameter data. Other than the above-mentioned, the tone generator circuit 7 may use the physical model method, harmonics synthesis method, formant synthesis method, analog synthesizer method using VCO, VCF and VCA, or analog simulation method. Further, the tone generator circuit 7 may be implemented by a combined use of a DSP and microprograms or of a CPU and software programs, rather than by use of dedicated hardware. The tone generation channels to simultaneously generate a plurality of tone signals in the tone generator circuit 7 may be implemented either by using a single circuit on a time-divisional basis or by providing a separate circuit for each of the tone generating channels.

The external storage device 9 is provided for storing melody creating parameters for use in automatic musical composition, performance data of existing music pieces, and data relating to control of the various programs for execution by the CPU 1. Where a particular control program is not prestored in the ROM 2, the particular control program may be prestored in the external storage device (e.g., hard disk device) 9, so that, by reading the control program from the external storage device 9 into the RAM 3, the CPU 1 is allowed to operate in exactly the same way as in the case where the particular control program is stored in the program memory 2. This arrangement greatly facilitates version upgrade of the control program, addition of a new control program, etc. The external storage device 9 may use any of various removable-type media other than the hard disk (HD), such as a floppy disk (FD), compact disk (CD-ROM or CD-RAM), magneto-optical disk (MO), digital versatile disk (DVD) and semiconductor memory.

The MIDI interface (I/F) 10 is provided for receiving or delivering tone information (MIDI data) from or to other MIDI equipment 10A or the like external to the automatic musical composition apparatus. Note that the other MIDI equipment 10A may be one operable in any desired manner or equipped with a performance operator unit of any desired type, such as the keyboard type, guitar type, wind instrument type, percussion instrument type or gesture type, as long as it can generate MIDI data in response to manipulations by the user or human player. Further, the communication interface 11 is connected to a communication network 11B, such as a LAN (Local Area Network), the Internet or telephone line network, via which it may be connected to a desired sever computer 11A so as to input a control program and various data to the automatic musical composition apparatus. Thus, in a situation where a particular control program and various data are not contained in the ROM 2 or external storage device (hard disk) 9, these control program and data can be downloaded from the server computer 11A via the communication interface 11. In such a case, the automatic musical composition apparatus, which is a "client", sends a command to request the server computer 11A to download the necessary control program and various data by way of the communication interface 11 and communication network 11B. In response to the command from the client, the server computer 11A delivers the requested control program and data to the automatic musical composition apparatus via the communication network 11B. The automatic musical composition apparatus receives the control program and data via the communication interface 11 and accumulatively store them into the external storage device (hard disk) 9. In this way, the necessary downloading of the control program and various data is completed.

Note that the MIDI interface 10 may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface 10, the other MIDI equipment 10A may be designed to communicate other data than MIDI event data. Needless to say, the musical information handled or processed in the present invention may be of any other data format than the MIDI format, in which case the MIDI interface 10 and other MIDI equipment 10A are constructed in conformity to the data format.

Figure 3:
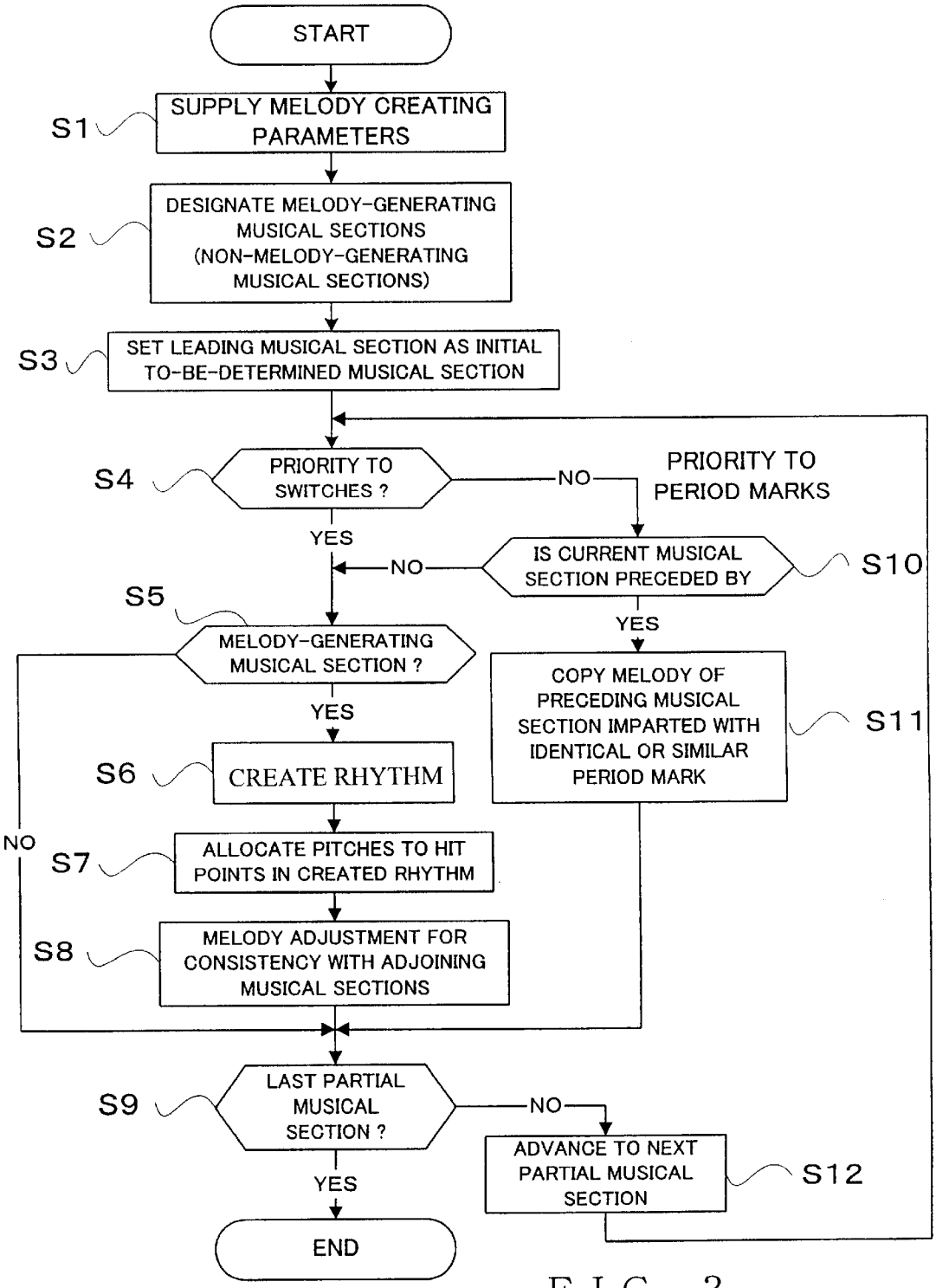
FIG. 3 is a flow chart showing an example of processing, performed in the embodiment, for automatically creating a melody only for a selected partial musical section of a music piece in accordance with ON/OFF settings of the melody creating switches.

The automatic musical composition apparatus of the present invention is arranged to automatically select a particular partial musical section in accordance with the ON/OFF setting of the melody creating switch MS provided for each of the partial musical sections, and automatically create a melody (more specifically, melody-related performance data) only for the selected particular partial musical section. The following paragraphs describe melody creation processing carried out in the instant embodiment for automatically creating a melody only for a selected particular partial musical section, with reference to a flow chart of FIG. 3. When an already-composed (existing) music piece is to be changed or modified, the music piece to be changed is selected in advance, and the processing of FIG. 3 is applied to the selected music piece.

At first step S1, melody creating data (i.e., melody creating parameters for setting desired musical conditions) are supplied to the automatic musical composition apparatus. More specifically, the melody creating data supplied here include those input by the user operating the panel operator unit (switches and other operators) 5A and performance operator unit (e.g., keyboard) 4A, those retrieved from the external storage device 9, or those received from the other MIDI equipment 10A or server computer 11A via the MIDI interface 10 or communication interface 11. The melody creating data are musical parameters characterizing various musical factors, such as a musical key, musical time, pitch leap dynamics, presence/absence of syncopation and chord progression, of the melody in question. At step S2, one or more melody-generating musical sections (or non-melody-generating musical sections) are designated by means of the melody creating switches MS. Namely, one or more melody-generating musical sections (or non-melody-generating musical sections) are determined in accordance with the ON/OFF states of the melody creating switches MS. Then, at step S3, the leading or first partial musical section of the music piece is set as an initial to-be-determined partial musical section, as a preparation for subsequent melody creation. In the instant embodiment, for every predetermined partial musical section starting with the leading partial musical section, a determination is made sequentially as to whether the partial musical section is a melody-generating musical section or a non-melody-generating musical section, and a melody is created (or re-created in the case where the existing music piece is to be modified) only for the melody-generating musical section (or only for the partial musical section determined as being not a non-melody-generating musical section) on the basis of the melody creating data. This is why step S3 sets the leading partial musical section of the music piece as the initial to-be-determined partial musical section so that the determination is made, sequentially from the leading partial musical section onward, as to whether or not the partial musical section is a melody-generating musical section.

At next step S4, a determination is made as to whether musical composition based on the ON/OFF setting of the melody creating switch MS has priority over musical composition based on a setting by period mark. Namely, it is determined whether melody creation for each partial musical section determined as the melody-generating musical section in accordance with the ON/OFF setting of the melody creating switch MS should be executed with priority over melody creation based on the setting by the period mark, or melody creation based on the setting by the period mark should be executed with priority. Generally speaking, each music piece is made up with one or more periods and predetermined period marks are imparted to the individual periods and arranged in the same order as the periods in the entire music piece, so that the period construction or sequence in the entire music piece can be indicated by or known from the sequence of the predetermined period marks. The period marks are intended to indicate similarity/dissimilarity between the periods. Thus, assuming that the music piece is made up of four periods and that a period mark "A" is imparted to the first period, period mark "B" (or "A'") to the second period, period mark "C" (or "B") to the third period and period mark "C'" (or "B'") to the fourth period, the period sequence or arrangement can be represented as "ABCC'" (or AA'BB'). In the instant embodiment, a period having a similar melody to a given original period is represented by adding a prime (') to the period mark of the original period. For example, a period having a similar melody to the A-type period is represented by the "A'" mark, and periods not similar to the A-type period are represented by other period marks, such as "B" and "C". Where an identical period mark is imparted to a plurality of periods in the music piece, the original melody of each of these periods may be copied as it is irrespective of the setting of the melody creating switch MS (namely, the setting by the period mark has the priority over the setting of the melody creating switch MS), because periods of the same type ordinarily have a same melody; however, in this case too, the melody creation may be executed with the priority given to the setting of the melody creating switch MS rather than to the setting by the period mark. For this reason, in this embodiment, the priority designating switch is provided to allow the user to instruct whether the priority should be given to the settings by the melody creating switches MS or to the settings by the period marks. Thus, the instant embodiment determines which of the settings by the melody creating switches MS and the settings by the period marks are now being given the priority via the priority designating switch; that is, the embodiment determines at step S4 whether or not the ON/OFF settings of the melody creating switches MS have the priority. As one of the melody creating musical conditions, the period marks indicative of the period sequence may be input to the composition apparatus. In the case where the period marks have the priority, the automatic musical composition is carried out in accordance with the period marks; otherwise, the period marks are ignored so that the automatic musical composition is carried out in accordance with the settings about the melody-generating musical sections.

If the ON/OFF settings of the melody creating switches MS do not have the priority over the settings by the period marks as determined at step S4 (NO determination at step S4), then the settings by the period marks are given the priority. Namely, in this case, a melody is created on the basis of the phrase marks irrespective of the ON/OFF settings of the melody creating switches MS. In creating a melody for a given partial musical section, a determination is made at step S10 as to whether the current partial musical section is preceded by any partial musical section to which is imparted an identical or similar period mark to the current partial musical section. With an affirmative (YES) determination at step S10, the melody of the preceding partial musical section having imparted thereto the identical or similar period mark to the current partial musical section is copied and set as the melody of the current partial musical section, at step S11. In case the partial musical section imparted with a leading one of the identical or similar period marks is not being designated as the melody-generating musical section, the operation of step S11 may be dispensed with. For example, where the period sequence of the music piece is "A (A-type period)—B (B-type period)—A (A-type period)" and the leading "A" period is not being designated as the melody-generating musical section, there is no need to perform the operation of step S11 because the second "A" period has the same contents as the first "A" period. After completion of the melody creation (i.e., melody copying) of the current partial musical section, the processing proceeds to step S9. On the other hand, if the ON/OFF settings of the melody creating switches MS have priority over the settings by the period marks as determined at step S4 (YES determination at step S4), or if the current partial musical section is not preceded by any other partial musical section having imparted thereto the identical or similar period mark to the current partial musical section (NO determination of step S10), a further determination is made at step; S5 as to whether or not the current partial musical section is being designated as the melody-generating musical section, i.e. whether the melody creating switch of the current partial musical section is in the ON state. If the current partial musical section is not being designated as the melody-generating musical section (NO determination at step S5), the processing of FIG. 3 jumps to step S9. Because of this, the music piece re-creation or modification is not carried out for each partial musical section having been set as the non-melody-generating musical section, and thus music piece data of every musical phrase favored by or satisfactory to the user can be preserved reliably. If, however, the current partial musical section is being designated as the melody-generating musical section (YES determination at step S5), a melody for the current partial musical section is created at steps S6 to S8. Namely, in the instant embodiment, partial melodies are created on a section-by-section basis in accordance with the ON/OFF settings of the melody creating switches MS. Note that part of the melody copied at step S11 may be modified so as to provide a partial musical section similar (not identical) to the preceding partial musical section.

For the melody creation, only a rhythm (i.e., tone generation timing information) of a melody for the current partial musical section is created at step S6. The rhythm creation may be performed by various known methods, such as one which searches through a predetermined database for a rhythm pattern matching with the genre (e.g., rock, jazz or classic) of the music piece in question and adopting the thus searched-out rhythm pattern. Then, at step S7, pitches are allocated to individual hit points (tone generation timing) in the created rhythm. For example, any one of chord-component notes of chords specified by a chord progression that is defined by the melody creating parameters may be randomly selected and allocated to each of the important hit points (which are specific hit points in a predetermined partial musical section musically characterizing a melody and which correspond, for example, to the beginning and downbeats of each measure) in the created rhythm, while any one of scale notes constituting the musical key of the music piece is allocated to each of the other hit points than the important hit points. After that, a melody adjustment process is carried out at step S8 for bringing the created melody of the current melody-generating musical section in proper consistency with the partial melodies of the partial musical sections adjoining the current melody-generating musical sections. Namely, in case the created melody of the current melody-generating musical section does not appropriately match with the partial melodies of the adjoining partial musical sections, the melody adjustment process performs, for example, an operation for re-generating the pitches of the current melody-generating musical section depending on whether the adjoining partial musical sections are the melody-generating musical section or non-melody-generating musical section. For example, no melody adjustment may be required when the pitches of the current melody-generating musical section have been generated in such a manner that the last pitch of the current melody-generating musical section appropriately matches with the first pitch of the next partial musical section. However, in case the last pitch of the current melody-generating musical section does not appropriately match with the first pitch of the next partial musical section (e.g., as in a situation where the last note is of a pitch to be subjected to a dominant motion), an musically unnatural connection would undesirably result between the current melody-generating musical section and the next partial musical section. Thus, in a case where the first pitch of the next partial musical section can be adjusted to appropriately match with the last pitch of the current melody-generating musical section (i.e., where the next partial musical section is set as the melody-generating section), it is only necessary that the last pitch of the current melody-generating musical section be used as it is (i.e., with no adjustment) and the first pitch of the next partial musical section be generated so as to match with the last pitch of the current melody-generating musical section during creation of the next partial musical section is created. On the other hand, in such a case where the first pitch of the next partial musical section can not be adjusted to appropriately match with the last pitch of the current melody-generating musical section (i.e., where the next partial musical section is set as the non-melody-generating section), the last pitch of the current melody-generating musical section is re-generated in stead of being adopted as it is. Namely, in this case, the first pitch of the next partial musical section can not be re-generated because the next partial musical section is set as the non-melody-generating section, and thus the melody adjustment is performed by re-generating the last pitch of the current melody-generating musical section. Further, if the last pitch of the partial musical section immediately preceding the current melody-generating musical section does not appropriately match with the first pitch of the current melody-generating musical section, then the first pitch of the current melody-generating musical section is re-generated. As an alternative, extent of pitch leaps in the melody may be input as one of the melody creating parameters so that the melody can be created on the basis of the input extent of pitch leaps. In this case too, the melody adjustment may be made between the current melody-generating musical section and the adjoining melody-generating or non-melody-generating musical sections. For example, the melody adjustment may be made such that the extent of pitch leaps falls within a value range input as the melody creating parameter. In the automatic musical composition operations of steps S6 to S8 for the current melody-generating musical section, the period mark for the current melody-generating musical section is ignored even when period marks indicative of a period sequence of the music piece have been input and set at step S1 above as one of the musical conditions.

At step S9, a determination is made as to whether or not the current partial musical section is the last partial musical section in the music piece. If answered in the affirmative at step S9, this means that there is no more melody-generating musical section following the current partial musical section, so that the melody creation processing of FIG. 3 is brought to an end. If, on the other hand, the current partial musical section is not the last partial musical section of the music piece (NO determination at step S9), this means that there is at least one melody-generating musical section following the current partial musical section, so that the processing advances to the next melody-generating musical section at step S12, after which the processing reverts to step S4 in order to repeat the operations of steps S4 to S12 on the next melody-generating musical section.

Namely, in the instant embodiment having been described so far, a complete melody for an entire music piece can be composed while partly changing the melody, by re-creating a melody for each melody-generating musical section and using the already-created melody as it is (as initially created or with no change) for each non-melody-generating musical section.

Note that the melody adjustment process of step S8 may be omitted in a situation where the melody to be created need not necessarily be of high musical quality level. Further, the above-described melody creating scheme performed at steps S6 to S8 is just illustrative and may be replaced with any other suitable melody creating scheme.

Now, a description will be made about the melody creation in the case where the settings by the period marks have priority over the settings of the melody creating switches MS, with reference to FIG. 4 which is a schematic diagram explanatory of processing for creating a melody in accordance with the settings by the period marks.

In the case where the melody creating switch MS in the ON state designates the "melody-generating musical section", a melody is created for the melody-generating musical section for which the melody creating switch MS is set in the ON state. Periods imparted with a same period mark ordinarily have a same melody as noted earlier, and thus where an identical period mark is imparted to a plurality of periods in the music piece (in the illustrated example of FIG. 4, a same period mark "A" is imparted to both period 1 of block 1 and period 1 of block 2), the melody of each of these periods may be copied as it is (with no change) irrespective of the settings of the melody creating switches MS (in the case where the settings by the period marks have the priority, i.e. when a NO determination has been made at step S4 of FIG. 3). Where both period 1 of block 1 and period 1 of block 2 are imparted with the "A" period mark as illustrated in FIG. 4, the melody of period 1 of block 2 can be created by copying the melody of period 1 of block 1, irrespective of the ON/OFF setting of the melody creating switch MS associated with period 1 of block 2. However, as previously stated, the ON/OFF settings of the melody creating switches MS may be given priority over the settings by the period marks even where an identical period mark is imparted to a plurality of periods. For example, in the illustrated example of FIG. 4, the ON/OFF settings of the melody creating switches MS may be given the higher priority such that the melody of phrase 1 in period 1 of block 2 is fixed (left unchanged) and only the melody of phrase 2 in period 1 of block 2 is created (i.e., the melody created for period 1 of block 1 is copied without the melody period 1 of block 2 being created). Further, the instant embodiment may be arranged such that the user can make a selection or setting as to which of the settings by the period marks and the ON/OFF settings of the melody creating switches MS should be given the higher priority. The flow chart of the melody creation processing having been described above in relation to FIG. 3 depicts one example where the user can make such a selection.

Where similar period marks (e.g., "A" and "A'") are imparted to a plurality of periods of the music piece in question, the same operations as in the case where the identical period mark is imparted to a plurality of periods will take place. However, if the user has made the selection such that the settings by the period marks are given the higher priority in such a case, a melody for the whole of a given period is re-created by copying only the melody of the former half of the period and re-creating the melody of the latter half of the period, rather than by copying the melody of the entire period to create the melody for the corresponding partial musical section.

Note that in the case where an identical or similar period marks are imparted to a plurality of periods, it is not always necessary to create a melody for the current partial musical section by copying a melody of the period imparted with the identical or similar period mark to the current partial musical section. For example, there may be provided a "copying inhibiting switch" so that inhibition of the copying from the period imparted with the identical or similar period mark to the current partial musical section can be instructed by a user's operation of the copying inhibiting switch; alternatively, the inhibition of the copying may be instructed using a command menu or the like. Such inhibition of the copying permits flexible melody creation especially in the case where the melody creating switches MS instruct melody creation for a plurality of partial musical sections or where an identical or similar period marks are imparted to a plurality of periods. Further, in the case where the settings by the period marks are given the higher priority, the inhibition of the copying can appropriately apply if the user does not want a melody to be created by free melody copying from the period imparted with the identical or similar period mark to the current partial musical section. Alternatively, whether or not to copy the melody from the period imparted with the identical or similar period mark to the current partial musical section may be inquired of the user so that the melody copying is inhibited so as to prevent the melody re-creation based on the copying if the user refuses such copying. Namely, by re-executing the automatic musical composition processing based on the given musical conditions rather than merely copying the melody, the present invention can create music piece data with slight differences (nuances) from the initially-created music piece data.

Figure 5:
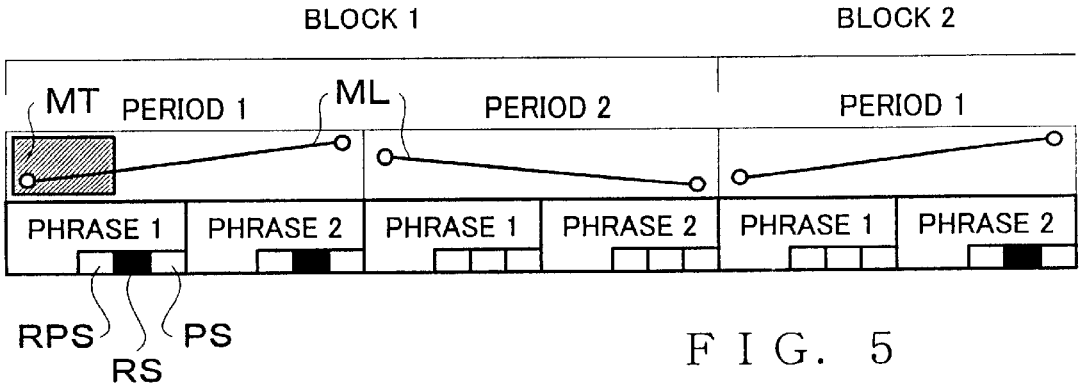
FIG. 5 is a conceptual diagram showing a modified embodiment of the invention where a plurality of switches, i.e. rhythm and pitch creating switch, only-rhythm creating switch and only-pitch creating switch, are provided for each partial musical section of a music piece.

The preceding paragraphs have described the embodiments where the melody creating switches MS are provided for merely designating the melody-generating musical sections so that rhythms and pitches are generated for melody creation for the individual melody-generating musical sections on the basis of the ON/OFF settings of the melody creating switches MS. However, in the melody re-creation, the user often wants to change only the rhythm or pitches of the melody in question. In such a case, re-creating the melody by changing both the rhythm and the pitches for one partial musical section will also change a melody rhythm or pitches for another partial musical section that should not be changed, which is quite inconvenient. To avoid the inconvenience, there may be provided, for each partial musical section, a switch RS for generating only rhythm and a switch PS for generating only pitches as well as a switch RPS for generating both rhythm and pitches in such a manner that a melody is created as desired by the user through re-generation of only the melody rhythm or melody pitches. Namely, apart from the rhythm and pitch generating switch RPS, there may be provided the only-rhythm generating switch RS to change the rhythm alone for recreation of the melody and the only-pitch generating switch PS to change the pitches alone for recreation of the melody. FIG. 5 is a conceptual diagram showing such a modified embodiment where a plurality of the switches, i.e. the rhythm and pitch generating switch RPS, only-rhythm generating switch RS and only-pitch generating switch PS, are provided for each of the partial musical sections.

As seen from FIG. 5, the plurality of the switches, i.e. the rhythm and pitch generating switch RPS, only-rhythm generating switch RS and only-pitch generating switch PS, are provided for each partial (i.e., unit) musical section (in the illustrated example, phrase-level musical section which is the smallest unit musical section of the melody) of a melody generated on the display device 6A. As explained earlier, each melody can be divided into a plurality of partial (unit) musical sections, and the melody creation of the invention is executed for each melody-generating musical section. This is why the rhythm and pitch generating switch RPS, only-rhythm generating switch RS and only-pitch generating switch PS are provided or displayed for each of the partial (unit) musical sections. Needless to say, these rhythm and pitch generating switch RPS, only-rhythm generating switch RS and only-pitch generating switch PS may be provided for each period-level musical section or block-level musical section longer than the phrase-level musical section and/or measure-level musical section shorter than the phrase-level musical section, in addition to or in place of each phrase-level musical section. In other words, the rhythm and pitch generating switch RPS, only-rhythm generating switch RS and only-pitch generating switch PS may be provided for each of the musical sections belonging to a plurality of hierarchical brackets, such as the period-level and phrase-level musical sections. When the rhythm and pitch generating switch RPS is operated to change both rhythm and pitches for melody re-creation, the same operation as in the above-described case where the melody creating switch MS is provided for each predetermined partial musical section takes place, although not specifically described here to avoid unnecessary duplication.

When the only-rhythm generating switch RS is operated in the embodiment, a melody is created with only the melody rhythm changed. In the case where the only-rhythm generating switch RS is operated for melody creation and if neither rhythm nor pitches are present yet in the designated melody-generating musical section or if only rhythm (no pitches) is present in the designated melody-generating musical section, a rhythm is generated by selecting and retrieving, in accordance with the musical genre or the like of the music piece in question, any one of a plurality of rhythms stored in a database. If both rhythm and pitches are already present in the designated melody-generating musical section, a portion or all of the pitches are preserved with only the rhythm being replaced, or only a rhythm is generated without the pitches being preserved (i.e., with the pitches discarded). In the former case where the rhythm is replaced with the pitches preserved, a rhythm having the same number of notes as the original rhythm is selected as a new rhythm from the database in accordance with the musical genre or the like of the music piece, and the pitches preserved are allocated to the new rhythm in the same order as the original pitches. If the rhythm is replaced with only a portion of the pitches preserved, the number of notes in the new rhythm may differ from that in the original rhythm. If the number of notes in the new rhythm is smaller than the number of the preserved pitches, the preserved pitches are adopted or allocated starting with the leading or first preserved pitch, and each one of the preserved pitches more than necessary for the new rhythm is discarded. If, on the other hand, the number of notes in the new rhythm is greater than the number of the preserved pitches, then the preserved pitches are allocated to the new rhythm in the same order as the original pitches, and each lacking or deficient pitch is newly generated. Note that the pitches may be allocated to the new rhythm from the last pitch backward, rather than from the first pitch onward. Further, even where pitches are already present in the designated melody-generating musical section, only a rhythm may be generated with the already-present pitches being discarded. With such an arrangement for allowing the user to set, for each melody-generating musical section of the music piece, whether or not to generate only a melody rhythm, it is possible to re-generate a melody rhythm for a given partial musical section while preserving the original melody pitches.

When the only-pitch generating switch PS is operated in the embodiment, a melody is created with only the melody pitches changed. In the case where the only-pitch generating switch PS is operated for melody creation like this, chord-component notes are randomly allocated to the important hit points in the rhythm, while scale notes are randomly allocated to the unimportant hit points in the rhythm. In an alternative, however, scale notes may be randomly allocated to all of the hit points in the rhythm without discrimination between the important hit points and the unimportant hit points. With such an arrangement for allowing the user to set, for each melody-generating musical section of the music piece, whether or not to generate only melody pitches, it is possible to re-generate melody pitches for a partial musical section while preserving the original melody rhythm.

It should further be appreciated that the melody creation in accordance with the present invention may be performed using any suitable melody creation scheme as long as it allows the user to set, for each predetermined partial musical section of the music piece, whether or not to generate a melody.

Further, the above-mentioned melody creating switches MS, rhythm and pitch generating switch RPS, only-rhythm generating switch RS, only-pitch generating switch PS, etc. may be in the form of hardware switches rather than the software switches visually displayed on the display device 6A. In such a case, these switches may be used in combination with any other desired functions.

Whereas the foregoing paragraphs have described the case where the three types of creating switches, i.e. rhythm and pitch generating switch RPS, only-rhythm generating switch RS and only-pitch generating switch PS, are provided for each partial (unit) musical section, only a switch for instructing whether or not to create a melody may be provided for each partial musical section, and an arrangement for selecting any one of "rhythm and pitches", "only rhythm" and "only pitches" as the subject to be generated or modified may be provided for each partial musical section separately from the instructing switch. Furthermore, only the only-rhythm generating switch RS and only-pitch generating switch PS may be provided for each partial musical section, without the rhythm and pitch generating switch RPS being provided at all, in such a manner that the two switches RS and PS can be simultaneously activated; namely, in this case, an arrangement may be made such that rhythm and pitches are generated in response to simultaneous activation of the two switches RS and PS.

Figure 4:
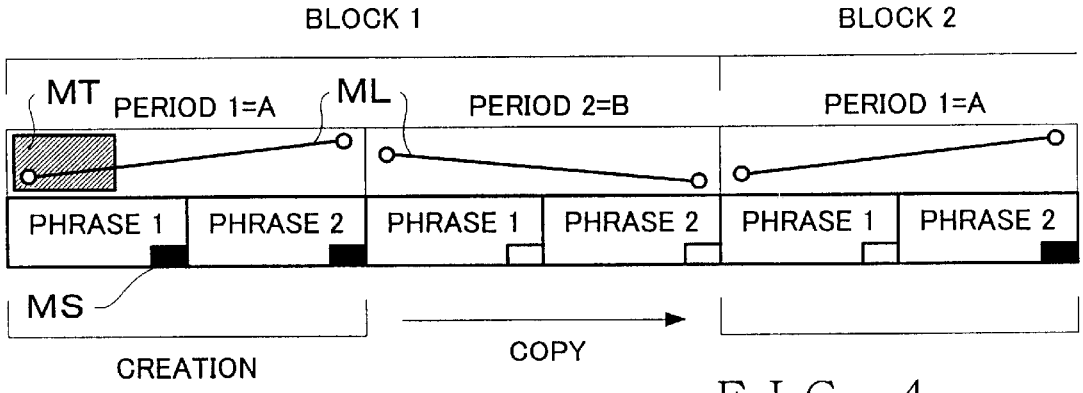
FIG. 4 is a conceptual diagram explanatory of processing, performed in the embodiment, for creating a melody in accordance with settings by period marks of a music piece.

In addition, as shown in FIGS. 2, 4 and 5, there may be displayed pitch-variation representing lines ML in association with individual periods. Each of the pitch-variation representing lines ML is plotted by connecting two pitches of the leading and last important hit points in the corresponding period, and it represents a general pitch varying state in the period. With such pitch-variation representing lines ML, the user is allowed to readily determine partial musical sections where melody recreation is to be re-executed (or to not be re-executed). Further, where the melody creation is based on such a scheme that creates a complete melody for an entire music piece by developing a certain input motif, the location of the motif in a period where the motif is present may be displayed in a highlighted fashion; in the illustrated examples of FIGS. 2, 4 and 5, the location of the motif is indicated by a hatched rectangular block MT. With such an arrangement, the user is: allowed to readily determine partial musical sections where melody re-creation is to be re-executed (or to not be re-executed). Moreover, depending on identity, similarity and dissimilarity between periods, the displaying style, such as the color, fill-in pattern and or shape, of the highlighted display MT may be differentiated. For example, the "A"-type and "A'"-type periods may be displayed in blue, the "B"-type and "B'"-type periods may be displayed in red, and so on.

The present invention is applicable not only to partial change or re-creation of an already-composed (existing) music piece but also to automatic composition of an entirely new music piece. In such a case, there is no need to perform an operation for selecting a to-be-modified music piece prior to initiation of the operational flow of FIG. 3 as in the above-described embodiment, and the automatic musical composition processing can be carried out starting with the operational flow of FIG. 3. In this case, partial musical sections to which the melody creating data (first musical conditions) supplied at step S1 of FIG. 3 should be applied can be partly designated through the musical section designating operation of step S2. Stated otherwise, each partial musical section, for which the musical composition using the melody creating data (first musical conditions) supplied at step S1 should be inhibited, is designated at step S2. Thus, as a first stage, a music piece is created with no music piece data present in the musical-composition-inhibited partial musical sections. Then, as a second stage, the musical conditions to be supplied at step S1 and the settings about the melody-generating and non-melody-generating musical sections made at step S2 are modified (namely, second musical conditions and partial musical sections to which the second musical conditions are to be applied are set), after which the flow of FIG. 3 is executed again. For example, each of the partial musical sections where the musical composition has been made at the first stage is designated as the non-melody-generating musical section, while each of the partial musical sections where the musical composition has not been made at the first stage is designated as the melody-generating musical section. Thus, the composition of a desired music piece can be ultimately completed by executing the operational flow of FIG. 3 a given number of times while modifying the musical conditions to be supplied at step S1 and the settings about the melody-generating and non-melody-generating musical sections made at step S2. With such arrangements, it is possible to automatically generate music piece data collectively for dispersedly-located partial musical sections to which common musical conditions are applicable, during which time automatic generation of music piece data can be reliably inhibited for the other partial musical sections to which the musical conditions are not to be applied. As a result, the present invention permits automatic musical composition with greatly enhanced efficiency.

It should be appreciated that the present invention is also applicable to automatic composition of accompaniment music pieces, without being limited to automatic composition of melody music pieces.

In the case where the automatic musical composition apparatus of the present invention is applied to an electronic musical instrument, the electronic musical instrument may be other than the keyboard type instrument, such as a stringed instrument, wind instrument or percussion instrument type. It should also be appreciated that the electronic musical instrument is not limited to the type where the tone generator device, automatic musical composition apparatus, etc. are incorporated together within the body of the electronic musical instrument, and may be of another type where the tone generator device, automatic musical composition apparatus, etc. are provided separately from each other but can be connected with each other via MIDI interfaces and communication facilities such as a communication network. Further, the electronic musical instrument may comprise a combination of a personal computer and application software, in which case various processing programs may be supplied from a storage medium, such as a magnetic disk, optical disk or semiconductor memory or supplied via a communication network. Further, the automatic musical composition apparatus of the present invention may be applied to karaoke apparatus, automatic performance apparatus such as player pianos, electronic game apparatus, portable communication terminals such as cellular phones. In the case where the automatic musical composition apparatus of the present invention is applied to a portable communications terminal, part of the functions of the portable communication terminal may be assigned to a server, rather than performed by the portable communication terminal alone, so that the portable communications terminal and server jointly perform all of the predetermined functions.

It should also be appreciated that where the performance data of a melody to be created may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. Further, the processing of the created performance data during an automatic performance may be performed by any suitable scheme, such as one in which the processing period is changed in accordance with a set tempo, or one in which the way of counting timing data contained in the performance data is changed per processing in accordance with the tempo with the processing period held constant. Furthermore, where performance data for a plurality of channels are handled in the present invention, the performance data for the plurality of channels may be stored together in a mixture or the performance data for these channels may be stored separately from each other on a track-by-track basis.

In summary, the present invention having been described so far is characterized by allowing the user to set, for each predetermined partial musical section of a music piece, whether or not to create music piece data of a melody or the like and permitting re-creation of the music piece data of the melody or the like only for each selected partial musical section. With this arrangement, the present invention can readily compose melodies and the like which have a higher degree of musical completeness or perfection.

Further, because the present invention allows the user to instruct which of the melody creation based on settings as to whether or not to create a melody and the melody creation based on identical/similar period marks should be given a higher priority, it can re-create a melody of each selected partial musical section while reflecting the identity/ similarity of the period marks or without reflection the identity/similarity of the period marks.

What is claimed is:

1. An automatic musical composition apparatus comprising:

a processing section that automatically composes a music piece on the basis of a given musical condition; and a setting section that, for each partial musical section in a music piece, makes a setting as to whether or not music piece data should be generated for the partial musical section, wherein said processing section discriminates, in accordance with the setting made by said setting section, between a data-generating musical section where music piece data should be generated and a non-data-generating musical section where no music piece data should be generated and generates music piece data based on the given musical condition for the data-generating musical section without generating music piece data based on the given musical condition for the non-data-generating musical section.

2. An automatic musical composition apparatus as claimed in claim 1 wherein said setting section makes a setting, for each partial musical section in an already-composed music piece, as to whether or not music piece data should be generated for the partial musical section, and wherein music piece data for the data-generating musical section in the already-composed music piece is re-generated by said processing section while music piece data for the non-data-generating musical section in the already-composed music piece is left unchanged, and thereby the already-composed music piece is modified.

3. An automatic musical composition apparatus as claimed in claim 1 wherein said setting section makes a setting, for each partial musical section in a music piece to be newly composed, as to whether or not music piece data should be generated for the partial musical section, and wherein said processing section generates music piece data for the data-generating musical section in the music piece to be newly composed but inhibits generation of music piece data for the non-data-generating musical section in the music piece to be newly composed, so as to partially generate music piece data for the music piece by applying the given musical condition only to particular one or more said data-generating musical sections.

4. An automatic musical composition apparatus as claimed in claim 1 wherein said setting section makes a setting, in correspondence with each partial musical section, as to whether or not only note-generation timing data should be generated for the partial musical section, and wherein said processing section discriminates, in accordance with the setting made by said setting section, between a data-generating musical section where note-generation timing data should be generated and a non-data-generating musical section where no note-generation timing data should be generated, and wherein said processing section generates note-generation timing data for the data-generating musical section on the basis of the given musical condition but inhibits generation of note-generation timing data for the non-data-generating musical section.

5. An automatic musical composition apparatus as claimed in claim 4 wherein said setting section makes a setting, for each partial musical section in an already-composed music piece, as to whether or not note-generation timing data should be generated for the partial musical section, and wherein note-generation timing data for the data-generating musical section in the already-composed music piece is re-generated by said processing section so that the note-generation timing data for the data-generating musical section in the already-composed music piece is changed, while note-generation timing data for the non-data-generating musical section in the already-composed music piece is left unchanged.

6. An automatic musical composition apparatus as claimed in claim 1 wherein said setting section makes a setting, in correspondence with each partial musical section, as to whether or not only pitch data of each note to be generated should be generated for the partial musical section, and wherein said processing section discriminates, in accordance with the setting made by said setting section, between a data-generating musical section where pitch data should be generated and a non-data-generating musical section where no pitch data should be generated, and wherein said processing section generates pitch data based on the given musical condition only for the data-generating musical section but inhibits generation of pitch data for the non-data-generating musical section.

7. An automatic musical composition apparatus as claimed in claim 6 wherein said setting section makes a setting, for each partial musical section in an already-composed music piece, as to whether or not pitch data should be generated for the partial musical section, and wherein pitch data for the data-generating musical section in the already-composed music piece is re-generated by said processing section so that note pitches are changed for the data-generating musical section in the already-composed music piece but note pitches are left unchanged for the non-data-generating musical section in the already-composed music piece.

8. An automatic musical composition apparatus as claimed in claim 1 wherein said setting section is capable of making a setting as to whether or not music piece data should be generated for a desired one of a plurality of partial musical sections divided from a music piece in different manners of dividing, which further comprises a priority control section that, when said setting section has made mutually-contradictory settings for two partial musical sections partly overlapping with each other, performs control such that either one of the settings has priority over other of the settings, and wherein said processing section discriminates between a data-generating musical section where music piece data should be generated and a non-data-generating musical section where no music piece data should be generated, in accordance with the setting made by said setting section for the partial musical section that has been given the priority by said priority control section.

9. An automatic musical composition apparatus as claimed in claim 1 which further comprises an instruction section that instructs whether or not the setting made by said setting section should have priority over a musical composition process based on period marks, and wherein when said instruction section has instructed that the setting made by said setting section should not have the priority over the musical composition process based on the period marks, said processing section ignores the setting made by said setting section for the partial musical section within at least one of at least two periods that are indicated by the period marks as identical or similar to each other.

10. An automatic musical composition apparatus as claimed in claim 9 wherein said processing section copies, music piece data of other of the at least two periods that are indicated by the period marks as identical or similar to each other, and said processing section generates, for the period of which the setting made by said setting section has been ignored, music piece data identical or similar to the music piece data of the other of the at least two periods on the basis of the copied music piece data.

11. An automatic musical composition apparatus as claimed in claim 9 wherein even when said instruction section has instructed that the setting made by said setting section should not have the priority over the musical composition process based on the period marks, said processing section, for other of the at least two periods that are indicated by the period marks as identical or similar to each other, discriminates between the data-generating musical section and the non-data-generating musical section in accordance with the setting made by said setting section for the partial musical section within the other period and generates music piece data based on the given musical condition for each discriminated data-generating musical section.

12. An automatic musical composition apparatus as claimed in claim 9 wherein when said instruction section has instructed that the setting made by said setting section should have the priority over the musical composition process based on the period marks, said processing section, for each one of the at least two periods that are indicated by the period marks as identical or similar to each other, discriminates between the data-generating musical section and the non-data-generating musical section in accordance with the setting made by said setting section and generates music piece data based on the given musical condition for each said discriminated data-generating musical section.

13. An automatic musical composition apparatus as claimed in claim 1 wherein the music piece comprises a plurality of hierarchical brackets divided in different manners of dividing, and said setting section is capable of making a setting, for each partial musical section in each of the hierarchical brackets, as to whether or not music piece data should be generated for the partial musical section.

14. An automatic musical composition apparatus as claimed in claim 13 wherein said setting section is capable of making a setting, for each partial musical section in a predetermined one of the hierarchical brackets, as to whether or not music piece data should be generated for the partial musical section, in such a manner that the predetermined hierarchical bracket is given priority over any other of the plurality of hierarchical brackets.

15. An automatic musical composition apparatus as claimed in claim 1 which further comprises a display device, and wherein said setting section makes a setting, for each said partial musical section, as to whether music piece data should be generated for the partial musical section, by means of a software switch displayed on said display device.

16. An automatic musical composition apparatus as claimed in claim 1 wherein said processing section further performs a music-piece-data modification process so as to provide consistency in music progression between a particular data-generating musical section of the music piece where music piece data based on the given musical condition has been generated and another partial musical section of the music piece adjoining the particular data-generating musical section.

17. An automatic musical composition apparatus comprising:

a processing section that automatically composes a music piece on the basis of a given musical condition; and a setting section that, for each partial musical section in a music piece, sakes a setting as to whether or not music piece data should be generated for the partial musical section, wherein said processing section is cable of performing:

a first process for discriminating, in accordance with the setting made by said setting section, between a data-generating musical section where music piece data should be generated and a non-data-generating musical section where no music piece data should be generated, and generating music piece data based on the given musical condition for the data-generating musical section without generating music piece data based on the given musical condition for the non-data-generating musical section; and a second process for generating music piece data in accordance with a period mark imparted to each period constituting the music piece, and which further comprises an instruction section that instructs said processing section to perform either one of said first and second processes with priority over other of said first and second processes.

18. An automatic musical composition apparatus as claimed in claim 17 wherein the music piece comprises a plurality of hierarchical brackets divided in different manners of dividing, and said setting section is capable of making a setting, for each partial musical section in each of the hierarchical brackets, as to whether or not music piece data should be generated for the partial musical section.

19. An automatic musical composition apparatus as claimed in claim 18 wherein said setting section is capable of making a setting, for each partial musical section in a predetermined one of the hierarchical brackets, as to whether or not music piece data should be generated for the partial musical section, in such a manner that the predetermined hierarchical bracket is given priority over any other of the plurality of hierarchical brackets.

20. An automatic musical composition apparatus as claimed in claim 17 which further comprises a display device, and wherein said setting section makes a setting, for each said partial musical section, as to whether music piece data should be generated for the partial musical section, by means of a software switch displayed on said display device.

21. An automatic musical composition apparatus as claimed in claim 17 wherein said processing section further performs a music-piece-data modification process so as to provide consistency in music progression between a particular data-generating musical section of the music piece where music piece data based on the given musical condition has been generated and another partial musical section of the music piece adjoining the particular data-generating musical section.

22. An automatic musical composition apparatus comprising:

a supply device that supplies a musical condition parameter;

a setting device that, for each partial musical section in a music piece, makes a setting as to whether or not music piece data should be generated for the partial musical section;

a first generator device that discriminates, in accordance with the setting made by said setting device, between a data-generating musical section where music piece data should be generated and a non-data-generating musical section where no music piece data should be generated, and generates, only for the data-generating musical section, music piece data based on the musical condition parameter supplied by said supply device;

a second generator device that generates music piece data in accordance with a period mark imparted to each period constituting the music piece; and a control device that performs a control to give priority to music piece data generation by said second generator device over music piece data generation by said first generator device.

23. An automatic musical composition apparatus as claimed in claim 22 wherein the music piece comprises a plurality of hierarchical brackets divided in different manners of dividing, and said setting device is capable of making a setting, for each partial musical section in each of the hierarchical brackets, as to whether or not music piece data should be generated for the partial musical section.

24. An automatic musical composition apparatus as claimed in claim 23 wherein said setting device is capable of making a setting, for each partial musical section in a predetermined one of the hierarchical brackets, as to whether or not music piece data should be generated for the partial musical section, in such a manner that the predetermined hierarchical bracket is given priority over any other of the plurality of hierarchical brackets.

25. An automatic musical composition apparatus as claimed in claim 22 which further comprises a display device, and wherein said setting section makes a setting, for each said partial musical section, as to whether music piece data should be generated for the partial musical section, by means of a software switch displayed on said display device.

26. An automatic musical composition apparatus as claimed in claim 22 wherein said first generator device further performs a music-piece-data modification process so as to provide consistency in music progression between a particular data-generating musical section of the music piece where music piece data based on the supplied musical condition parameter has been generated and another partial musical section of the music piece adjoining the particular data-generating musical section.

27. An automatic musical composition method comprising:

a supply step of supplying a musical condition;

a setting step of, for each partial musical section in a music piece, making a setting as to whether or not music piece data should be generated for the partial musical section; and a processing step of discriminating, in accordance with the setting made by said setting step, between a data-generating musical section where music piece data should be generated and la non-data-generating musical section where no music piece data should be generated, and generating music piece data based on the supplied musical condition for the data-generating musical section without generating music piece data based on the supplied musical condition for the non-data-generating musical section.

28. An automatic musical composition method as claimed in claim 27 wherein said setting step makes a setting, for each partial musical section in an already-composed music piece, as to whether or not music piece data should be generated for the partial musical section, and wherein music piece data for the data-generating musical section in the already-composed music piece is re-generated by said processing step while music piece data for the non-data-generating musical section in the already-composed music piece is left unchanged, and thereby the already-composed music piece is modified.

29. An automatic musical composition method as claimed in claim 27 which further comprises an instruction step of instructing whether or not the setting made by said setting step should have priority over a musical composition process based on period marks, and wherein when said instruction step has instructed that the setting made by said setting step should not have the priority, said processing step ignores the setting made by said setting step for the partial musical sections within at least one of at least two periods that are indicated by the period marks as identical or similar to each other.

30. An automatic musical composition method comprising:

a supply step of supplying a musical condition;

a setting step of, for each partial musical section in a music piece, making a setting as to whether or not music piece data should be generated for the partial musical section;

a processing step capable of performing:

a first process for discriminating, in accordance with the setting made by said setting step, between a data-generating musical section where music piece data should be generated and a non-data-generating musical section where no music piece data should be generated, and generating music piece data based on the supplied musical condition for the data-generating musical section without generating music piece data based on the supplied musical condition for the non-data-generating musical section; and a second process for generating music piece data in accordance with a period mark imparted to each period constituting the music piece; and an instruction step of instructing said processing step to perform either one of said first and second processes with priority over other of said first and second processes.

31. A machine-readable storage medium containing a group of instructions to cause said machine to perform an automatic musical composition method, said automatic musical composition method comprising:

a supply step of supplying a musical condition;

a setting step of, for each partial musical section in a music piece, making a setting as to whether or not music piece data should be generated for the partial musical section; and a processing step of discriminating, in accordance with the setting made by said setting step, between a data-generating musical section where music piece data should be generated and a non-data-generating musical section where no music piece data should be generated, and generating music piece data based on the supplied musical condition for the data-generating musical section without generating music piece data based on the supplied musical condition for the non-data-generating musical section.

32. A machine-readable storage medium as claimed in claim 31 which further comprises an instruction step of instructing whether or not the setting made by said setting step should have priority over a musical composition process based on period marks, and wherein when said instruction step has instructed that the setting made by said setting step should not have the priority, said processing step ignores the setting made by said setting step for the partial musical sections within at least one of at least two periods that are indicated by the period marks as identical or similar to each other.

33. A machine-readable storage medium containing a group of instructions to cause said machine to perform an automatic musical composition method, said automatic musical composition method comprising:

a supply step of supplying a musical condition;

a setting step of, for each partial musical section in a music piece, making a setting as to whether or not music piece data should be generated for the partial musical section;

a processing step capable of performing:

a first process for discriminating, in accordance with the setting made by said setting step, between a data-generating musical section where music piece data should be generated and a non-data-generating musical section where no music piece data should be generated, and generating music piece data based on the supplied musical condition for the data-generating musical section without generating music piece data based on the supplied musical condition for the non-data-generating musical section; and a second process for generating music piece data in accordance with a period mark imparted to each period constituting the music piece; and an instruction step of instructing said processing step to perform either one of said first and second process with priority over other of said first and second processes.

* * * * *